United States Patent [19]

Otrusina

[11] Patent Number: 5,054,170

[45] Date of Patent: Oct. 8, 1991

[54] CONNECTOR ENGAGEABLE IN MULTIPLE POSITIONS AND RELEASABLE IN ONLY ONE POSITION

[76] Inventor: Edward C. Otrusina, 8118 Newport Drive South, Willow Springs, Ill. 60480

[21] Appl. No.: 670,727

[22] Filed: Mar. 18, 1991

[51] Int. Cl.[5] ..... A45F 5/00

[52] U.S. Cl. ..... 24/597; 24/3 R; 24/3 F; 24/663; 24/669; 224/272; 224/197

[58] Field of Search ..... 24/3 R, 3 F, 109, 663, 24/669, 682, 702, 597, 3 J, 3 L; 224/197, 271, 272

[56] References Cited

U.S. PATENT DOCUMENTS

| | | | |
|---|---|---|---|
| 1,519,380 | 12/1924 | Kochauski | 24/669 |
| 3,743,147 | 7/1973 | Wilczynski . | |
| 3,797,717 | 3/1974 | Collins . | |
| 3,878,589 | 4/1975 | Schaefer . | |
| 4,419,794 | 12/1983 | Horton, Jr. et al. | 24/682 X |
| 4,587,818 | 5/1986 | Griffin . | |
| 4,605,335 | 8/1986 | Otrusina . | |
| 4,619,020 | 10/1986 | Lecher, Sr. . | |
| 4,676,420 | 6/1987 | Sharp . | |
| 4,718,586 | 1/1988 | Hagino . | |
| 4,754,528 | 7/1988 | Lyons et al. . | |
| 4,757,927 | 7/1988 | Rutty . | |
| 4,821,934 | 4/1989 | Alessi et al. . | |

*Primary Examiner*—James R. Brittain

*Attorney, Agent, or Firm*—Emrich & Dithmar

[57] ABSTRACT

A quick-release connecting apparatus for mounting an object on a belt includes male and female members, respectively attachable to the object and the belt-mountable holder. The female member has a generally U-shaped receptacle formed therein which opens at a peripheral edge of the female member, and an aperture formed in the front surface of the female member which is aligned with but smaller than the receptacle and communicates therewith. The male member has a stud projecting therefrom with a circular button at its distal end which is too large to pass through the aperture but is dimensioned to be receivable in the receptacle from its open end with the stud disposed through the aperture and is rotabale about the axis of the stud while disposed in the receptacle. A yieldable detent projects from the female member into the entrance of the receptacle so as to be deflectable by the button to permit insertion thereof in any position into the receptacle. The button has a recess which receives the detent member to permit removal of the button from the receptacle in only one rotational orientation of the male member, while the detent member prevents removal of the button from the receptable in any other rotational orientation of the male member.

20 Claims, 1 Drawing Sheet

CONNECTOR ENGAGEABLE IN MULTIPLE POSITIONS AND RELEASABLE IN ONLY ONE POSITION

BACKGROUND OF THE INVENTION

1. Field of the Invention

The present invention relates to connecting or fastening devices, and particularly to a connecting apparatus that permits an object, such as a radio paging receiver or the like, to be removably fastened to a belt mountable holder.

2. Description of the Prior Art

A number of connecting apparatuses have heretofore been provided which include male and female members engageable with each other. One such connecting apparatus for mounting an object on a belt is disclosed in my U.S. Pat. No. 4,605,335, and includes a male member with a peculiarly shaped button which mates with a like-shaped opening which leads into a receptacle in a female member, the button then being rotatable to a locked configuration prevent removal from the receptacle. In this prior arrangement the button is "plugged" axially into the opening, much like a key is inserted in a keyhole, so that it is insertable in and removable from the receptacle in only one orientation. Once inserted, if it is rotated to any other orientation it will be locked in place, preventing removal.

Other types of connecting apparatuses have used similar arrangements wherein the receptacle is top-loading so that the button can be slid into the receptacle through its open end rather than being plugged axially thereinto. Such an arrangement is disclosed, for example, in U.S. Pat. No. 3,878,589. But in these apparatuses also, the male member or button can be inserted into and removed from the receptacle in only one orientation of the male member, and in all other orientations will be locked in place in the receptacle.

In many applications the requirement that the male member be disposed in a single predetermined orientation in order to permit its engagement with the female member is a considerable inconvenience.

SUMMARY OF THE INVENTION

It is a general object of the present invention to provide an improved apparatus for detachably interconnecting two objects which avoids the disadvantages of prior apparatuses while affording additional structural and operating advantages.

An important feature of the invention is the provision of an apparatus of the type set forth which includes male and female members and which permits the male member to be inserted in the female member in any of a plurality of orientations, while permitting removal of the male member from the female member in only one orientation.

Another feature of the invention is the provision of an apparatus of the type set forth, which is of relatively simple and economical construction.

These and other features of the invention are attained by providing apparatus for detachably interconnecting two objects including in combination: a female member adapted to be secured to one of the objects and defining a receptacle and an entrance leading into the receptacle, a male member adapted to be secured to the other object and having an engagement portion with an axis, the engagement portion being shaped and dimensioned to be movable into and out of the receptacle through the entrance and rotatable about the axis while in the receptacle, detent means yieldably carried by the female member and projecting into the entrance for interference with passage of the engagement portion therethrough, the detent means being yieldably deflectable by the engagement portion to accommodate passage thereof into the receptacle irrespective of the rotational orientation of the male member with respect to the axis of the engagement portion, and a recess formed in the engagement portion and shaped and dimensioned to receive the detent means in only one rotational orientation of the male member when the engagement portion is disposed in the receptacle to accommodate movement of the engagement portion from the receptacle through the entrance, the engagement portion being engageable with the detent means in all rotational orientations other than the one rotational orientation of the male member when the engagement portion is disposed in the receptacle to prevent movement of the engagement portion from the receptacle through the entrance.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
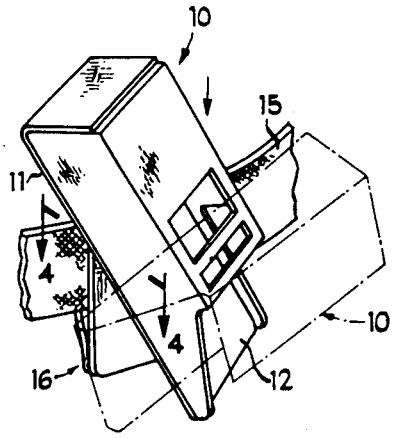
FIG. 1 is a fragmentary perspective view illustrating the mounting of a holster, in two different orientations respectively shown in solid and broken line, on a belt-mountable loop by means of the connecting apparatus of the present invention.
Figure 2:
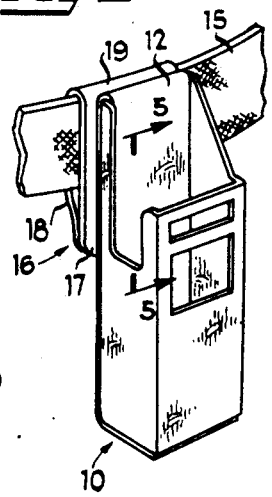
FIG. 2 is a view similar to FIG. 1, illustrating the holster after having been mounted on the loop and rotated to a use position.
Figure 3:
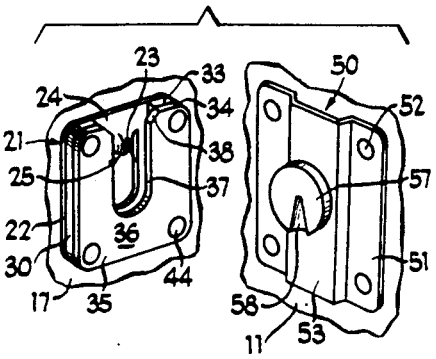
FIG. 3 is an enlarged perspective view of the male and female members of the attachment apparatus of the present invention when oriented as in FIG. 2.
Figure 4:
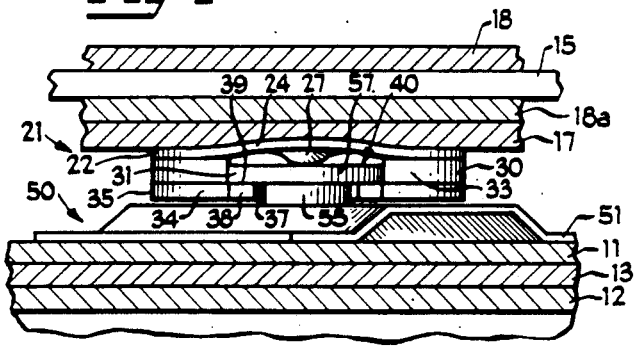
FIG. 4 is a further enlarged, fragmentary view in horizontal section, taken generally along the line 4—4 in FIG. 1 and illustrating the cooperation of the male and female members of the connecting apparatus of FIG. 3 during mounting of the holster on the loop.
Figure 5:
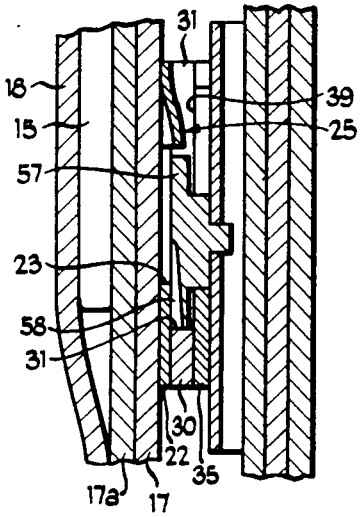
FIG. 5 is a further enlarged, fragmentary view in vertical section taken along the line 5—5 in FIG. 2, and illustrating the connecting apparatus of FIG. 3 after the holster has been mounted on the loop.
Figure 6:
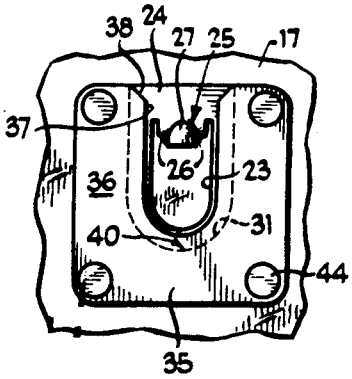
FIG. 6 is an enlarged, front elevational view of the female member of the connecting apparatus of FIG. 3.
Figure 8:
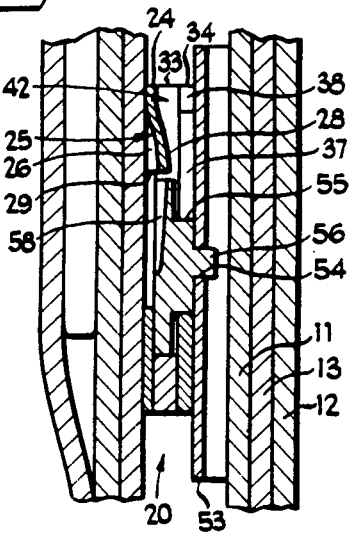
FIG. 8 is a view similar to FIG. 5, illustrating the orientation of the holster and male member as in FIG. 7 for removal of the holster from the loop of FIGS. 1 and 2.

Referring to FIGS. 1 and 2, there is illustrated a holster 10 of the type used for holding a radio pager or the like, the holster 10 having a rear wall 11 which has a flap 12 foldable down along the inside of the holster for cooperation with the rear wall 11 to sandwich therebetween a stiffening plate 13 (see FIGS. 4, 5 and 8). The holster 10 is mountable on a belt 15 by means of a hanger loop 16 which has a pair of legs 17 and 18 interconnected by a bight 19 and connectable at the ends thereof opposite the bight 19 by suitable snaps or the like (not shown). If desired, a stiffening plate 17*a* may be secured to the inner surface of the leg 17 (see FIGS. 4, 5 and 8). The holster 10 is detachably mounted on the hanger loop 16 by means of the connecting apparatus 20 of the present invention.

Referring now to FIGS. 3-8, the connecting apparatus 20 includes a female member 21 and a male member 50 which are respectively mountable on the leg 17 of the hanger loop 16 and the rear wall 11 of the holster 10 for cooperation to mount the holster 10 on the hanger loop 16. The female member 21 may be of multi-part construction, including a flat, generally rectangular base plate 22 having a generally U-shaped opening 23 formed therein centrally thereof and defining an arm 24 extending across the upper end of the opening 23. Depending from the arm 24 into the upper end of the opening 23 is a detent member 25 which is generally rectangular in shape but has the corners thereof folded under to define folded legs 26 and is deformed to define an outwardly projecting bead 27 (see FIG. 6) which has a cam surface 28 thereon which slopes downwardly and outwardly from the arm 24, terminating in a stop edge 29 (see FIGS. 4, 6 and 8). Overlapping the base plate 22 substantially congruent therewith is a rectangular center plate 30 having a generally U-shaped notch 31 formed therein from an upper peripheral edge 33 thereof. The notch 31 is aligned with and shaped similarly to the opening 23 in the base plate 22, but is larger than the opening 23, so that the side edges of the notch 31 are spaced apart further than the sides of the opening 23 and the arcuate bottom of the notch 31 has a larger radius than the arcuate bottom of the opening 23, as can best be seen in FIG. 6.

The female member 21 also includes a front plate 35 which overlies the center plate 30 substantially congruent therewith and has a front surface 36. A U-shaped aperture 37 is formed in the front plate 35 from the top edge thereof, the upper ends of the side walls of the aperture 37 being chamfered, as at 38. The aperture 37 is aligned with the opening 23 and the notch 31 and is approximately the same size as the former. Thus, the peripheral edges of the aperture 37 extend inwardly beyond the edges of the notch 31 for cooperation therewith to define a bearing surface 39 (see FIGS. 4 and 5) along the inner surface of the front plate 35. The bearing surface 39 cooperates with the side wall of the notch 31 and with the overlapped portion of the base plate 22 to define a generally U-shaped receptacle 40 (FIGS. 4 and 6), the upper end of which opens at the top edge of the female member 21 and forms an entrance portion 42 (FIG. 8) into which the detent member 25 projects. A plurality of rivets 44 or other suitable fasteners fixedly secure the plates 22, 30 and 35 of the female member 21 together and to the leg 17 of the hanger loop 16.

The male member 50 includes a rectangular plate 51 which is secured by rivets 52 or other suitable fasteners to the rear wall 11 of the holster 10. The central portion of the plate 51 is raised to define a generally rectangular channel 53 which extends between the top and bottom edges of the plate 51 substantially parallel to the side edges thereof. An opening 54 (FIG. 8) is formed through the plate 51 centrally of the channel 53 and receives therethrough a mounting lug 56 of a cylindrical stud 55. The lug 56 may be peened over, or the like, fixedly to secure the stud 55 to the plate 51. The stud 55 projects outwardly from the plate 51 substantially perpendicular thereto and has formed at its distal end an enlarged-diameter, disk-like, circular button 57 which is coaxial with the stud 55. Formed in the outer surface of the button 57 is a generally triangular-shaped recess 58, which has its apex at the center of the button 57 and diverges to the periphery thereof to form a sector of the circular button 57. The recess 58 increases in depth from the center toward the periphery of the button 57 and has at its outer end a depth substantially equal to the distance that the detent member 25 projects above the outer surface of the arm 24. The button 57 has a thickness slightly less than the thickness of the center plate 30 of the female member 21 and a diameter slightly less than the width of the receptacle 40 and substantially greater than the width of the aperture 37 in the front plate 35 of the female member 21, and is spaced from the channel 53 a distance slightly greater than the thickness of the front plate 35, while the stud 55 has a diameter slightly less than the width of the aperture 37.

Referring now in particular to FIGS. 1, 2, 4, 5 and 8, the operation of the connecting apparatus 20 will be described. It will be appreciated that the female member 21 is mounted on the hanger loop 16 so that, in use, the receptacle 40 will open upwardly when the hanger loop 16 is mounted on the belt 15 of a user. Thus, the female member 21 defines an open-top or top-loading receptacle 40. In use, the holster 10 is positioned with the male member 50 facing the female member 21 and substantially parallel thereto, as indicated in FIGS. 1 and 4. The button 57 is then inserted into the open entrance portion 42 of the receptacle 40, as illustrated in FIG. 4, and slid downwardly in the direction of the arrows in FIG. 1. The button 57 will cammingly engage the cam surface 28 of the detent member 25, causing an inward deflection of the detent member 25 and the arm 24 into the leg 17 of the hanger loop 16 (FIG. 4) to permit the button 57 to move past the detent member 25 into a mounted position in the lower end of the receptacle 40. It is a significant aspect of the present invention that, because of the shape and size of the button 57 relative to the receptacle 40, the button 57 may be inserted into the receptacle 40 in any rotational orientation of the male member 50 relative to the axis of the stud 55, as indicated in FIG. 1. Once the button 57 has moved past the detent member 25 into the lower end of the receptacle 40, the holster 10 may be rotated about the axis of the stud 55 to the upright use position illustrated in FIGS. 2 and 5. It can be seen that, in this configuration, the button 57 is trapped in the receptacle 40, since it is too large to pass through the aperture 37 in the front plate 35, and the stop edge 29 of the detent member 25 prevents upward movement through the entrance portion 42 of the receptacle 40.

Figure 7:
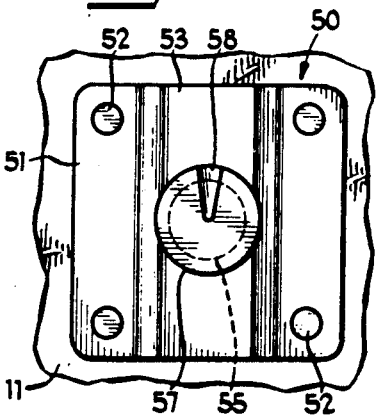
FIG. 7 is an enlarged, front elevational view of the male member of the connecting apparatus of FIG. 3, rotated 180° from the FIG. 3 position.

In order to remove the holster 10 from the hanger loop 16, it is necessary to invert the holster 10 to the orientation illustrated in FIGS. 7 and 8, in which the recess 58 of the button 57 is disposed immediately beneath the detent member 25 in alignment therewith. The holster 10 may then be moved upwardly through the entrance portion 42 of the receptacle 40, with the detent member 25 being received in the wide end of the recess 58. The decreasing depth of the recess 58 toward the center of the button 57 provides a camming action, permitting the button 57 to be easily cammed past the detent member 25 to disengage the male member 50 from the female member 21. It will be appreciated that, in any rotational orientation of the male member 50 other than that illustrated in FIGS. 7 and 8, the recess 58 will not align with the detent member 25, so that the button 57 will continue to engage the stop edge 29 of the detent member 25, holding the button 57 locked in the receptacle 40. Thus, the parts of the connecting apparatus 20 may be engaged in any rotational orientation of the male member 50 with respect to the axis of the stud 55, but they may be disengaged in only one such rotational orientation, i.e., that illustrated in FIG. 8.

In a constructional model of the invention, the male and female members 50 and 21 are formed of metal, but it will be appreciated that they could be formed of other suitable materials. Also, while the female member 21 is illustrated as being of a multi-part construction, other constructions would be possible to achieve the same results.

From the foregoing, it can be seen that there has been provided an improved connecting apparatus which is of simple and economical construction and which provides ready engagement of two parts in multiple orientations while permitting disengagement in only a single orientation.

I claim:

1. Apparatus for detachably interconnecting two objects including in combination: a female member adapted to be secured to one of the objects and defining a receptacle and an entrance leading into said receptacle, a male member adapted to be secured to the other object and having an engagement portion with an axis, said engagement portion being shaped and dimensioned to be movable into and out of said receptacle through said entrance and rotatable about said axis while in said receptacle, detent means yieldably carried by said female member and projecting into said entrance for interference with passage of said engagement portion therethrough, said detent means being yieldably deflectable by said engagement portion to accommodate passage thereof into said receptacle irrespective of the rotational orientation of said male member with respect to the axis of said engagement portion, and a recess formed in said engagement portion and shaped and dimensioned to receive said detent means in only one rotational orientation of said male member when said engagement portion is disposed in said receptacle to accommodate movement of said engagement portion from said receptacle through said entrance, said engagement portion being engageable with said detent means in all rotational orientations other than said one rotational orientation of said male member when said engagement portion is disposed in said receptacle to prevent movement of said engagement portion from said receptacle through said entrance.

2. The apparatus of claim 1, wherein said entrance is disposed at a peripheral edge of said female member.

3. The apparatus of claim 1, wherein said engagement portion includes a stud projecting from said male member.

4. The apparatus of claim 1, wherein said engagement portion is moved into and out of said receptacle in directions substantially perpendicular to said axis.

5. The apparatus of claim 4, wherein said entrance defines a slot leading into said receptacle.

6. The apparatus of claim 1, wherein said detent means projects into said entrance in a direction transverse to the direction of movement of said engagement portion into and out of said receptacle.

7. The apparatus of claim wherein said detent means includes a cam surface cammingly engaged by said engagement portion during passage thereof into said receptacle to facilitate deflection of said detent means.

8. Apparatus for detachably interconnecting two objects including in combination: a female member adapted to be secured to one of the objects and having a front surface and an aperture in said front surface which extends to a peripheral edge thereof and has an open end thereat, said female member having a receptacle formed therein behind said front surface, said receptacle being larger than said aperture and communicating with the entire area of said aperture and having an entrance which opens at a peripheral edge of said female member adjacent to the open end of said aperture, a male member adapted to be secured to the other object and having a stud projecting therefrom and a button at the distal end of said stud, said button being dimensioned to prevent passage thereof through said aperture in directions normal to said front surface but to accommodate passage to and from said receptacle in directions parallel to said front surface from said peripheral edge thereof with said stud extending through said opening and further to accommodate rotation of said button about the axis of said stud while in said receptacle, detent means yieldably carried by said female member and projecting into the entrance portion of said receptacle near the open end of said aperture for interference with passage of said button into and out of said receptacle in directions parallel to said front surface, said detent means being yieldably deflectable by said button to accommodate passage of said button into said receptacle irrespective of the rotational orientation of said male member with respect to the axis of said stud, and a recess formed in said button and shaped and dimensioned to receive said detent means in only one rotational orientation of said male member when said button is disposed in said receptacle to accommodate movement of said button from said receptacle, said button being engageable with said detent means in all rotational orientations other than said one rotational orientation of said button when said button is disposed in said receptacle to prevent movement of said button from said receptacle.

9. The apparatus of claim 8, wherein said aperture is generally U-shaped.

10. The apparatus of claim 8, wherein said detent means projects toward said front surface.

11. The apparatus of claim 10, wherein said detent means includes a cam surface cammingly engageable by said button during movement thereof into said receptacle to facilitate deflection of said detent means.

12. The apparatus of claim 10, wherein said cam surface slopes toward said front surface and away from the open end of said aperture.

13. The apparatus of claim 8, wherein said recess is generally triangular in shape.

14. The apparatus of claim 13, wherein said recess increases in depth toward the wide end thereof.

15. The apparatus of claim 8, wherein said button is substantially circular in shape.

16. The apparatus of claim 15, wherein said recess forms a sector of said circular button.

17. The apparatus of claim 15, wherein said button is substantially in the form of a flat disk coaxial with said stud.

18. The apparatus of claim 17, wherein said disk is very slightly thinner than the thickness of said receptacle.

19. The apparatus of claim 8, wherein said male and female members are formed of metal.

20. The apparatus of claim 8, wherein said male member is of unitary one-piece construction.

* * * * *

UNITED STATES PATENT AND TRADEMARK OFFICE

CERTIFICATE OF CORRECTION

PATENT NO. : 5,054,170

DATED : October 8, 1991

INVENTOR(S) : Edward C. Otrusina

It is certified that error appears in the above-identified patent and that said Letters Patent is hereby corrected as shown below:

Column 6, line 13, after "claim" insert --1--.

Signed and Sealed this

Nineteenth Day of January, 1993

*Attest:*

DOUGLAS B. COMER

*Attesting Officer*

*Acting Commissioner of Patents and Trademarks*